US006793122B2

(12) United States Patent
Hardtke

(10) Patent No.: US 6,793,122 B2
(45) Date of Patent: Sep. 21, 2004

(54) METHOD FOR THE PRODUCTION OF REINFORCED HOLLOW SECTIONS WITH A CONTINUOUS PERIPHERY

(75) Inventor: Uwe Hardtke, Neu Wulmstorf (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/885,443

(22) Filed: Jun. 21, 2001

(65) Prior Publication Data

US 2002/0023333 A1 Feb. 28, 2002

(30) Foreign Application Priority Data

Jun. 21, 2000 (DE) ..... 100 29 467

(51) Int. Cl.[7] ..... B21D 39/00; B23K 31/02
(52) U.S. Cl. ..... 228/165
(58) Field of Search ..... 228/165, 193, 228/198, 173, 178, 135; 29/243.5, 432.1

(56) References Cited

U.S. PATENT DOCUMENTS 3,646,981 A * 3/1972 Barnes ..... 411/82
4,137,950 A 2/1979 Briscall
4,342,799 A * 8/1982 Schwochert ..... 428/35.7
4,448,430 A 5/1984 Bright
4,708,898 A * 11/1987 Gommier et al. ..... 428/36.9
4,769,391 A * 9/1988 Wycech ..... 264/267
5,106,031 A * 4/1992 Sanda et al. ..... 242/118.4
5,432,989 A * 7/1995 Turek ..... 29/243.5
5,457,929 A * 10/1995 Kim ..... 52/244
5,872,348 A * 2/1999 Watanabe et al. ..... 219/117.1
5,974,758 A 11/1999 Pielmeier
5,984,563 A * 11/1999 Wu ..... 29/243.5
6,134,767 A * 10/2000 Schulze ..... 29/432.1
6,296,330 B1 * 10/2001 Hall ..... 305/161
6,419,146 B1 * 7/2002 Buldhaupt et al. ..... 228/193
6,547,645 B2 * 4/2003 Devine, II ..... 451/40

FOREIGN PATENT DOCUMENTS

DE 19728582 A1 1/1999
EP 0823297 A1 2/1998

OTHER PUBLICATIONS

Tox Pressotechnik, LLC website www.tox–presso.com, Aug. 30, 2002.*

* cited by examiner

*Primary Examiner*—L. Edmondson
(74) *Attorney, Agent, or Firm*—Crowell & Moring LLP

(57) ABSTRACT

A method for the production of reinforced hollow sections with a continuous periphery. In order to provide in a simple manner, hollow sections with selective local reinforcement at points subject to high mechanical loads, an opening is formed in the periphery of the hollow section and a reinforcing plate is inserted into the opening, such that it at least projects into the hollow section. The reinforcing plate is then joined to the hollow section in the region of the edge of the opening.

12 Claims, 4 Drawing Sheets

METHOD FOR THE PRODUCTION OF REINFORCED HOLLOW SECTIONS WITH A CONTINUOUS PERIPHERY

BACKGROUND AND FIELD OF THE INVENTION

This application claims the priority of German application 100 29 467.7, filed Jun. 21, 2000, the disclosure of which is expressly incorporated by reference herein.

The present invention relates to a method for the production of reinforced hollow sections with a continuous periphery.

In order to reinforce a hollow section, the customary practice is to weld reinforcing plates to a hollow section. This type of reinforcement is often obstructive when fitting these kind of hollow sections in restricted spaces because of their large size. To compensate for the large size, the entire component would have to have a smaller cross section, thus reducing the strength of the component. This is very importance in the construction of motor vehicles, especially when producing axle beams.

The object of the present invention is to provide a production method which makes it possible in a simple manner to provide hollow sections with selective local reinforcement at points subject to high mechanical loads.

According to the present invention, an opening is introduced into the hollow section from outside at the point to be reinforced. This impairs neither the functionality of the hollow section nor its basic rigidity. A reinforcing plate is then introduced into the opening and joined to the hollow section in the region of the opening, giving rise locally to a multi-chamber section in the hollow section. This multi-chamber section represents a reinforcement of the hollow section, maintaining the characteristics and shape of the hollow section even when hollow sections with reinforcing plates welded on in the conventional manner collapse due to high mechanical loads. By means of the multi-chamber section, higher rigidities are achieved due to higher geometrical moments of inertia. This can be simply achieved even at points on the hollow section that are relatively inaccessible due to its shape. Moreover, there is no waste of installation space urgently required for other purposes. The reinforcing plate can have any desired shape. Another advantage of such method is the relatively low consumption of materials and thus the weight of the overall component is only slightly increased. The characteristics of welded-on plates, in contrast, depend on the surface of the component to be reinforced. This can be a very large surface and highly unconducive to effective welding attachment. In the case of joining by welding in accordance with the invention, the lengths of the weld seams for joining the reinforcing plate are significantly shorter than with external welds, with the result that less heat is introduced into the hollow section, thus reducing distortion of the material and therefore reducing the amount of finishing work.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
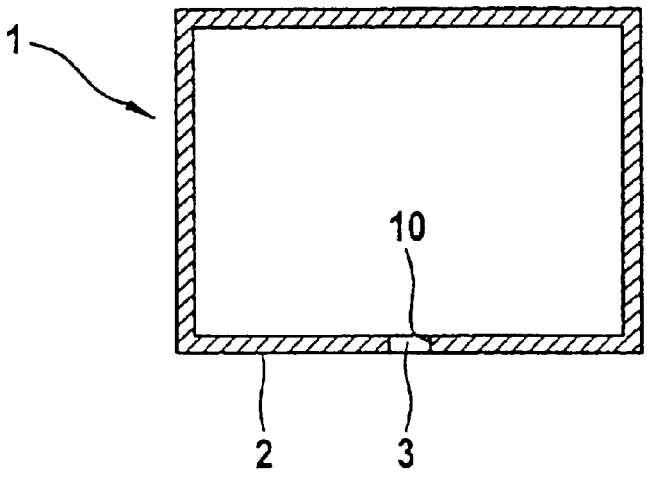
FIG. 1 shows a cross section through a hollow section with a peripheral opening according to the invention without a remnant from the hole.
Figure 2:
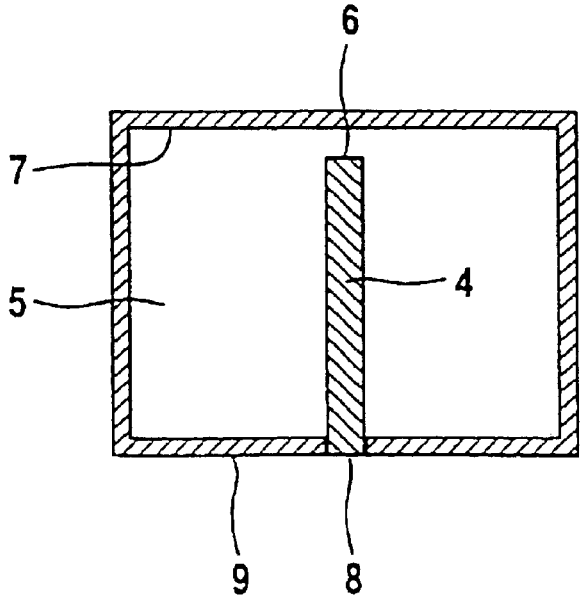
FIG. 2 shows a cross section through the hollow section from FIG. 1 with a reinforcing plate inserted in accordance with the invention, which does not touch the facing inner side of the hollow section opposite the opening.

FIG. 1 illustrates a hollow section 1, which, as with all the exemplary embodiments described below, can also be a motor-vehicle axle beam, in particular a rear-axle beam. In this case, the hollow section 1 is box-shaped in cross section but is not restricted to this specific form as regards the reinforcement to be achieved. A slotted opening 3, which is produced by punching, sawing or jet cutting, is formed on the underside 2 of the hollow section 1. A flat reinforcing plate 4 is inserted into the slotted opening 3 as illustrated in FIG. 2, and although this plate projects into the interior 5 of the hollow section as a reinforcing rib, its end 6 remote from the opening is at a distance from the facing inner side 7 of the hollow section. The other end 8 of the reinforcing plate 4 ends flush with the outer side 9 of the hollow section 1 in the region of the opening 3, and there is thus no disruption of the shape of the hollow section 1. The end 8 is welded laterally to the edge 10 of the opening by arc or beam welding to form a fine seam. Here, the reinforcing effect relates primarily to the area of the opening 3 in the hollow section 1, into which the reinforcing plate 4 is welded.

Figure 3:
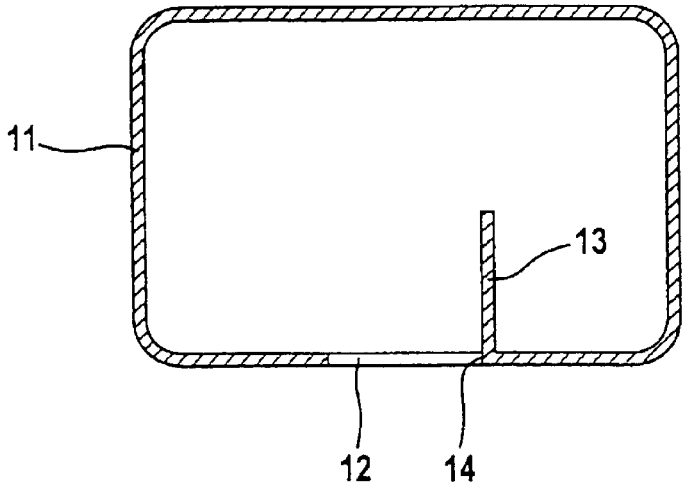
FIG. 3 shows a cross section through a hollow section with a peripheral opening according to the invention with an attached remnant from the hole.
Figure 4:
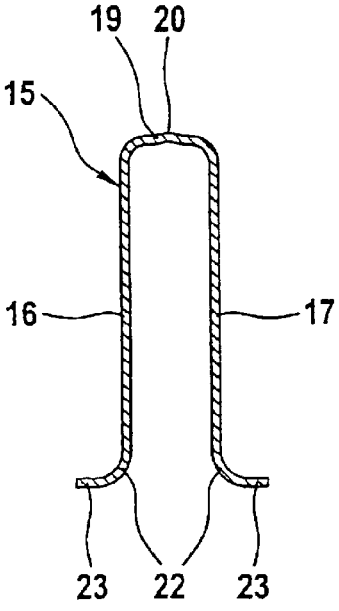
FIG. 4 shows a cross section through a U-shaped reinforcing plate with a projection formed on it.

In another exemplary embodiment in accordance with FIG. 3, an opening 12 is produced in a hollow section 11 by punching a hole, the remnant 13 from the hole remaining attached to a wall area of the edge 14 of the opening and projecting inwards. A reinforcing plate 15 designed as a U-shaped section illustrated in FIG. 4 is inserted into the opening 12 in accordance with FIG. 5 by means of a punch 18 surrounded by the sides 16, 17 of the plate, the punch simultaneously forming a welding electrode for the subsequent projection welding of the plate 15 to the inside 21 of the hollow section by way of additional joining, improving the efficiency of the process and cutting down the expense of the apparatus. For this purpose, a projection 20 is stamped into the bottom 19 of the section of the reinforcing plate 15, which can moreover be designed as a multi-sided section, or even a V-shaped section. When the section 15 is inserted into the opening 12, only the projection 20 comes to rest against the inside 21 of the hollow section. On each of its ends 22 opposite the bottom 19 of the section, the reinforcing plate 15 has a welding flange 23, which is bent out or over in a suitable way before insertion into the hollow section 11. By means of the welding flange 23, the reinforcing plate 15 rests against the outside 24 of the hollow section 11, overlapping the edge 14 of the opening. The reinforcing plate 15 is welded to the hollow section 11, preferably by beam welding or arc welding, by means of the welding flange 23, forming a fillet weld 25, simultaneously with the projection welding or in two successive welding passes. The dimensions of the reinforcing plate 15 should be chosen in such a way that, in the inserted position, the projection 20 touches the inside 21 of the hollow section and the gap formed between the welding flange 23 and the outside 24 can be bridged in a reliable process by arc welding. To prevent buckling of the hollow section 11 during projection welding, the hollow section 11 is supported by a die 26. Owing to the complete division of the hollow section 11 into two chambers 27 and 28, a considerably improved reinforcing effect is obtained.

Figure 5:
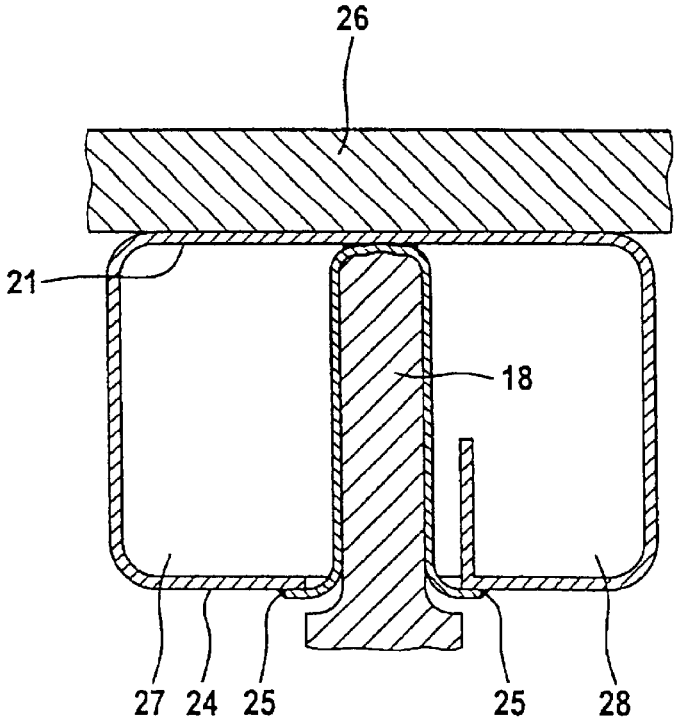
FIG. 5 shows a cross section through the hollow section in FIG. 3 with a reinforcing plate from FIG. 4 fitted, in engagement with the tool.
Figure 6:
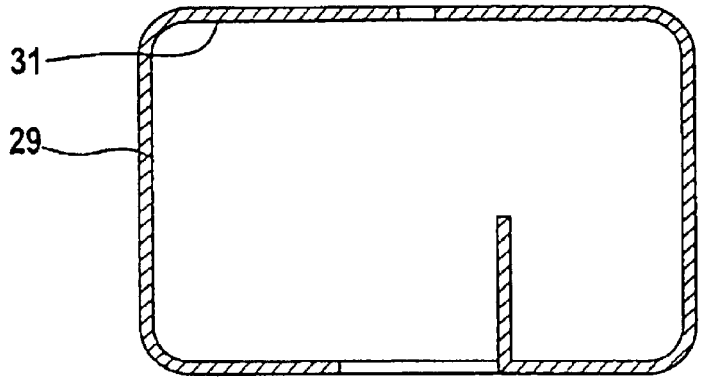
FIG. 6 shows a cross section through a hollow section with a peripheral opening according to the invention and a hole on the opposite side.
Figure 7:
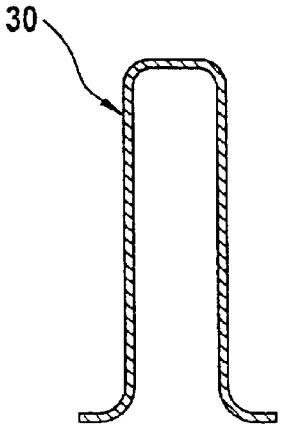
FIG. 7 shows a cross section through a U-shaped reinforcing plate.
Figure 8:
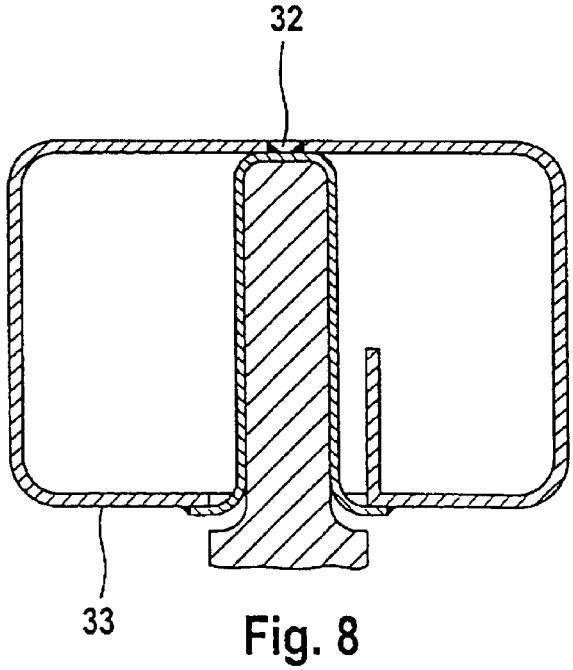
FIG. 8 shows a cross section through the hollow section in FIG. 6 with a reinforcing plate from FIG. 5 fitted and plug-welded, in engagement with the tool.

In another exemplary embodiment in accordance with FIGS. 6–8, as a departure from the exemplary embodiment in accordance with FIGS. 3–5, the hollow section 29 is perforated (FIG. 6) opposite the opening 12, at the point of contact between the reinforcing plate 30 and the inside 31 of the hollow section. The reinforcing plate 30 is formed without a projection 20 (FIG. 7) and rests flat against the inside 31 of the hollow section after insertion. Owing to the hole 32 formed, additional joining is possible from outside by means of a plug weld. Compared with spot or projection welding, plug welding makes it possible to produce continuous joints that can, fundamentally, be subjected to higher mechanical loads, thus giving an improved reinforcing effect with respect to mechanical loads.

The reinforcing plate 30, which, here too, is formed with welding flanges 23, can be designed without these welding flanges 23 and with dimensions such that it has rectilinear sides throughout and, when inserted into the opening 12, comes to rest against the facing inner side 31 of the hollow section, on the one hand, and with its edges ends flush with the outside 33 of the hollow section 29, within the opening 12, on the other hand. At the opening 12, it is then seam-welded to the edge 14 of the opening.

Figure 9:
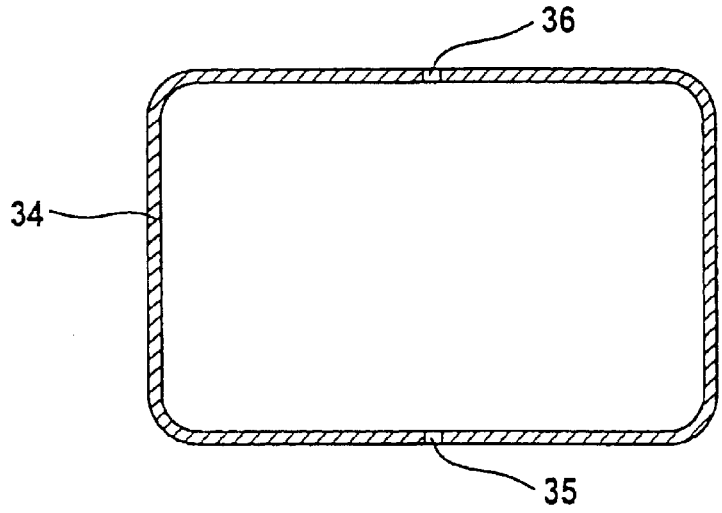
FIG. 9 shows a cross section through a hollow section slotted on both sides.
Figure 10:
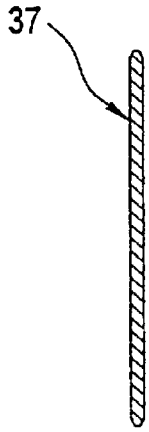
FIG. 10 shows a cross section through a flat reinforcing plate.
Figure 11:
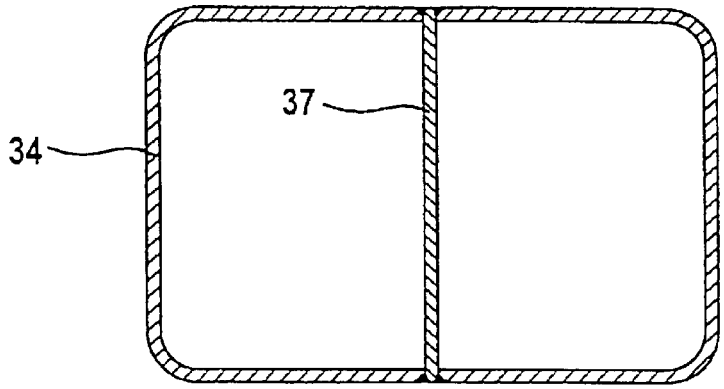
FIG. 11 shows a cross section through the hollow section from FIG. 9 joined to the reinforcing plate from FIG. 10 in accordance with the invention.

In another exemplary embodiment in accordance with FIGS. 9–11, the hollow section 34 is slotted at two diametrically opposite points to form openings 35 and 36 (FIG. 9). A preferably flat reinforcing plate 37 (FIG. 10) is then inserted through this slot formed by the openings 35 and 36. This plate is then welded to the hollow section 34 in the openings 35 and 36 (FIG. 11). The advantage in this variant is to be regarded as the fact that the hollow section 34 remains completely closed. It is thus impossible for spray or dirt to penetrate and thus have a corrosive effect. The reinforcing plate 37 furthermore has no welding flanges, thus saving materials and production costs. Given appropriate dimensioning of the reinforcing plate 37, the shape of the hollow section 34 moreover remains unaffected.

In all the variant embodiments described, it is advantageous that the hollow sections are given their final form by means of hydroforming before the formation of a peripheral opening. On the one hand, the desired shape and cross section of the hollow section are achieved and, on the other hand, very close tolerances can be achieved in the outside dimensions of the hollow sections, as required for the uniformity of the welding gaps since almost no springback of the material of the hollow section occurs with a hollow section formed in this way owing to its complete plasticization. It is furthermore advantageous to produce the openings and the holes opposite the latter during the hydroforming process. Extreme accuracy in the positioning of the openings and holes is thereby achieved, and precise reproducibility is thus obtained. The introduction of flat reinforcing plates is thereby facilitated.

As a further additional reinforcement, it is conceivable to stamp beads into the reinforcing plate before insertion into the opening. The reinforcing plates can be u-shaped, v-shaped or even z-shaped. Instead of joining by welding, adhesive bonding or, in the case of a U- or V-shaped section, even TOX clinching can be employed. It is, of course, an advantage here that the punch used to insert the section can form the counterpunch for TOX clinching.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for the production of a reinforced hollow section with a continuous periphery, comprising the steps of:

forming an opening in said periphery, inserting a reinforcing plate into the opening, such that it at least projects into the hollow section; and joining the reinforcing plate to the hollow section in the region of an edge of the opening.

2. The method according to claim 1, wherein beads are stamped into the reinforcing plate before insertion into the opening.

3. The method according to claim 1, wherein the dimensions of the reinforcing plate are designed in such a way that, when the reinforcing plate is inserted into the opening, it comes to rest against an opposite inner side of the hollow section, and, in addition to being joined to the edge of the opening, the reinforcing plate is also joined to said inner side.

4. The method according to claim 3, wherein the reinforcing plate is designed as a U- or V-section, and a projection is stamped into the bottom of the section, said projection being the only part to make contact with the inner side of the hollow section when a section is inserted into the opening, and the contact on the inside is made by projection welding.

5. Method for the production of reinforced hollow sections with a continuous periphery, comprising the steps of:

forming an opening in said periphery, inserting a reinforcing plate into the opening, such that it at least projects into the hollow section; and joining the reinforcing plate to the hollow section in the region of an edge of the opening, wherein the dimensions of the reinforcing plate are designed in such a way that, when the reinforcing plate is inserted into the opening, it comes to rest against an opposite inner side of the hollow section, and, in addition to being joined to the edge of the opening, the reinforcing plate is also joined to said inner side, wherein the reinforcing plate is designed as a U- or V-section, and a projection is stamped into the bottom of the section, said projection being the only part to make contact with the inner side of the hollow section when a section is inserted into the opening, and the contact on the inside is made by projection welding, wherein the section is inserted by means of a punch surrounded by the sides of the section, the punch simultaneously forming a welding electrode for the projection welding.

6. The method according to claim 1, wherein the reinforcing plate is joined to the inner side of the hollow section in the form of a U- or V-section by TOX clinching.

7. The method according to claim 1, wherein the hollow section is pierced at a point where the reinforcing plate rests against an inner side of the hollow section, and the plate is joined to the hollow section through said point by plug welding.

8. The method according to claim 1, wherein the hollow section is slotted at two diametrically opposite points and the reinforcing plate is inserted through the slotted openings and then joined.

9. The method according to claim 1, wherein the reinforcing plate is inserted into the opening in the hollow section with at least one of its end edges flush and is seam-welded to the opening at an edge of the opening.

10. The method according to claim 1, wherein a welding flange is bent out at one end of the reinforcing plate on at least one side, said welding flange being laid against an outer side of the hollow section so as to overlap the edge of the opening, and the reinforcing plate is welded to the hollow section by means of the welding flange by beam welding or arc welding thus forming a fillet weld.

11. The method according to claim 1, wherein the hollow section is converted into a final form by hydroforming before the formation of a peripheral opening.

12. The method according to claim 1, wherein the opening is formed by piercing assisted by hydroforming.

* * * * *